US007651292B2

(12) United States Patent
Tavares da Silva

(10) Patent No.: US 7,651,292 B2
(45) Date of Patent: Jan. 26, 2010

(54) COSMETIC DISPENSER

(75) Inventor: Reginaldo Alexandre Tavares da Silva, Seacroft (GB)

(73) Assignee: Conopco, Inc., Englewood Cliffs, NJ (US)

( * ) Notice: Subject to any disclaimer, the term of this patent is extended or adjusted under 35 U.S.C. 154(b) by 680 days.

(21) Appl. No.: 11/184,489

(22) Filed: Jul. 19, 2005

(65) Prior Publication Data

US 2006/0018702 A1 Jan. 26, 2006

(30) Foreign Application Priority Data

Jul. 20, 2004 (GB) ..... 0416251.7

(51) Int. Cl.
*B43K 7/10* (2006.01)

(52) U.S. Cl. ..... 401/214; 401/216

(58) Field of Classification Search ..... 401/208, 401/209, 212–214, 216
See application file for complete search history.

(56) References Cited

U.S. PATENT DOCUMENTS

| | | | | |
|---|---|---|---|---|
| 2,749,566 A | | 6/1956 | Thomas | 15/132.7 |
| 2,823,403 A | * | 2/1958 | Whitney | 401/213 |
| 2,858,558 A | | 11/1958 | Sudbeaz | 15/132.7 |
| 3,039,132 A | | 11/1959 | Hambley | 15/571 |
| 2,968,826 A | | 1/1961 | Leshin | 15/132.7 |
| 3,069,718 A | | 12/1962 | Brady et al. | 15/571 |
| 3,075,230 A | | 1/1963 | Marchant | 15/571 |
| 3,111,703 A | | 11/1963 | Kaufman | 15/572 |
| 3,284,839 A | | 11/1966 | Cook | 15/541 |
| 4,059,198 A | | 11/1977 | Mumford | 215/222 |
| 4,223,795 A | | 9/1980 | Akers | 215/222 |
| 4,434,903 A | | 3/1984 | Cooke | 215/222 |
| 4,811,726 A | | 3/1989 | Goncalves et al. | 128/57 |
| 5,213,431 A | | 5/1993 | Gentile et al. | 401/219 |
| 5,449,078 A | | 9/1995 | Akers | 215/222 |
| 5,810,495 A | * | 9/1998 | McAuley | 401/214 |
| 5,897,267 A | * | 4/1999 | Poolman et al. | 401/214 |
| 6,056,136 A | | 5/2000 | Taber et al. | 215/252 |
| 6,155,736 A | | 12/2000 | Evans et al. | 401/219 |

(Continued)

FOREIGN PATENT DOCUMENTS

CA 1078783 A * 6/1980

(Continued)

OTHER PUBLICATIONS

Derwent Abstract of DE 201 19 329—published Feb. 28, 2002.

(Continued)

*Primary Examiner*—Huyen Le
(74) *Attorney, Agent, or Firm*—Karen E. Klumas

(57) ABSTRACT

An improved housing for a roll-on has an inward end, an outward end and a side-wall having an interior surface extending from the inward to the outward ends, the outward end defining an aperture sufficiently narrow to retain the roller and permit a segment of the roller to extend outside the housing, and a spider mounted laterally within the housing on the interior surface of the side-wall at or adjacent to the inward end which spider is resiliently biased towards the roller and has a means for providing localised contact with the roller and providing a parallel spacing between the spider and roller. Especially desirably, the roller is a spherical ball.

29 Claims, 8 Drawing Sheets

U.S. PATENT DOCUMENTS

| | | | | |
|---|---|---|---|---|
| 6,179,505 | B1 | 1/2001 | Oder, III et al. | 401/213 |
| 6,511,243 | B2 | 1/2003 | Miranda | 401/213 |
| 2003/0080198 | A1 | 5/2003 | Garcia et al. | 239/44 |
| 2004/0213628 | A1 | 10/2004 | Thiebaut | 401/205 |

FOREIGN PATENT DOCUMENTS

| | | |
|---|---|---|
| DE | 1 020 776 | 12/1957 |
| DE | 198 27 965 | 12/1999 |
| DE | 299 14 452 | 1/2000 |
| DE | 201 19 329 | 4/2002 |
| DE | 102 11 483 | 9/2005 |
| EP | 046 038 | 4/1988 |
| EP | 1 384 416 | 1/2004 |
| GB | 116603 | 6/1918 |
| GB | 740220 | 11/1955 |
| GB | 1115861 | 5/1968 |
| GB | 1 515 078 | 6/1978 |
| GB | 2 255 052 | 10/1992 |
| GB | 2 268 912 | 1/1994 |
| GB | 2 272 186 | 5/1994 |
| GB | 2 275 024 | 8/1994 |
| WO | 00/49908 | 8/2000 |
| WO | 00/64302 | 11/2000 |
| WO | 02/08082 | 1/2002 |
| WO | 02/051283 | 7/2002 |

OTHER PUBLICATIONS

GB Search Report in a GB application GB 0416251.7.
European Search Report in an EP application EP 04 25 4334.
Derwent Abstract of 102 11 483—published Sep. 25, 2003.
GB Search Report in a GB application GB 0416253.3.
GB Search Report in a GB application GB 04 16248.3.
Co-pending Application: Applicant: Baines et al., U.S. Appl. No. 11/184,408, filed Jul. 19, 2005.
Co-pending Application: Applicant: Baines et al., U.S. Appl. No. 11/184,571, filed Jul. 19, 2005.
Co-pending Application: Applicant: Tavares da Silva; U.S. Appl. No. 11/184,655, filed Jul. 19, 2005.

* cited by examiner

COSMETIC DISPENSER

The present invention relates to improvements to a cosmetic dispenser and more particularly to improvements to a housing for a roll-on suitable for attachment to a bottle or reservoir to form a roll-on dispenser for a cosmetic liquid.

BACKGROUND AND PRIOR ART

One class of dispensers of cosmetic fluids, including in particular deodorants and antiperspirants is commonly called a roll-on dispenser or applicator. In such dispensers, a bottle or reservoir has an outlet aperture which is shaped to form a housing for a rotatable roller, commonly a ball, which conventionally is spherical. The roller is retained by the housing, having a fraction of its surface in fluid connection with the reservoir or bottle and a further fraction of its surface exposed outside the housing. In use, the roller can rotate within the housing, thereby conveying liquid from within the reservoir to outside the housing where it can be brought into contact with skin (or some other chosen surface). Although in some instances the housing is integral with the reservoir or bottle, it is often formed as a separate unit which is attached to the bottle by a suitable means, such as co-operating screw threads, or co-operating snap-fit beads on the respective contact surfaces of the housing and bottle.

Many users adopt similar applications habits, which is to say that they employ a similar number of strokes of the roll-on across the surface to which they are applying liquid, for example applying an antiperspirant or deodorant to the underarm or feet or other occluded body regions. Also they tend to use the dispenser for a similar length of time and it is believed that they seek to employ a similar application pressure between the dispenser and the skin, a pressure which enables the roll-on ball to roll over the skin surface rather than dig into it and/or slip. One problem that can arise with roll-on dispensers is that of controlling the amount of liquid that is applied, for example onto human skin by a user, or rather the lack of means in the dispenser itself to assist the user to apply a similar amount when adopting his or her normal application habit.

One adaptation proposed for roll-on housings comprises employing an intermediate reservoir between the main reservoir and the roller, a reserve which the roller can dip into on rotation and thereby replenish liquid that has been transferred onto the contacted surface, such as skin. Intermediate reservoirs are disclosed in for example U.S. Pat. No. 2,858,558, U.S. Pat. No. 3,111,703, GB-A-1115861, DE-A-19827965, DE 20119329A, DE 29914452, U.S. Pat. No. 3,075,230, U.S. Pat. No. 3,069,718, U.S. Pat. No. 3,284,839, U.S. Pat. No. 6,155,736, U.S. Pat. No. 6,179,505, WO-A-02/051283, GB 2268912A, and GB-A-2255052 amongst others, the roller being in the form of a ball or a cylindrical roller. However, the provision of an intermediate reservoir does not in itself regulate the depth of film adhering to the roller, but simply enables the fluid to be replenished.

An allied problem which can arise with roll-on dispensers is that of variation of the dose of fluid applied to the skin when applied by the user in the same application habit during the lifetime of the roll-on. It has been observed during a dosing study that after a start-up period, the dose applied from a current upright roll-on applicator can fluctuate significantly between successive applications, and that after about half of the dispenser contents has been applied, the average dose applied tends to diminish slowly whilst continuing to fluctuate between successive doses. This reduction in the dose may not be detected by the user, when following their regular application habit, for example taking a similar length of time and applying a similar number of application strokes. Thus, the efficacy of the dose can vary during the lifetime of the dispenser without being recognised by the user. It would be inherently advantageous for the dispenser to extend the proportion of cosmetic dispensed before tailing off commences and also advantageous to reduce the extent of fluctuation between successive doses.

A different type of adaptation to a roll-on housing for a bottle has been proposed in U.S. Pat. No. 2,968,826 which comprised a cylindrical housing having an integrally moulded resilient lateral spider (18) at its inward end, that is to say the end fitting into the bottle (10), and a ball-retaining lip (20) at its outward end against which a ball (27) was said to be normally forced by the spider (18) to seal the bottle. When the roll-on is rolled across the skin, '826 states that the ball was urged away from the lip thereby creating a narrow passage through which liquid could pass. However, in practice, the force needed to seal a ball against a housing is rather high, conventionally in the region of at least 3 kg-f, such as 4 to 8 kg-f, so that it would be very difficult for a user to operate a roll-on dispenser against a spider exerting such a ball-sealing force.

The dispenser of '826 has other disadvantages. Because the spider has a lateral surface facing the ball rather than a concave surface and a central button that contacts the ball, the height of the button does not control the rate of flow of liquid out of the dispenser or the film of liquid on the roll ball. Moreover, the gap between the lip of the ball during use of the roll-on to apply fluid is dependent on the pressure which the user exerts to overcome the outward bias of the spider. Inevitably, this gap is variable as a consequence, not only between users who are likely to exert different pressures from one another, but also during applications, especially in armpits where the angle of the hand changes during application as the roll-on follows the skin surface.

A housing for a roll-ball having an integrally moulded spider at its inward end is also described in DE 10211483. From the drawings, the ball-facing surface of the spider appears to have the same radius of curvature as the ball, which is patterned like a golf ball. The dispenser is sealed by an inner wall of the cap being forced against the exterior of the housing adjacent to its outward end. There is no suggestion of the spider having a means to control the gap between itself and the ball during dose application so as to regulate the depth of film on the ball.

In U.S. Pat. No. 5,213,431, there is described a roller dispenser in which beneath the cylindrical roller there is disposed an arcuate tray on the upper surface of which is moulded four ridges along substantially its entire length. The ridges are in contact with the length of the roller surface during its rotation whilst the dispenser is in use, not spaced from it. Accordingly, such ridges cannot provide a regulated depth of film, but serve to divide the tray into several reservoirs rather than one.

In GB 1515078, there is described a dispenser in which a transverse annular ring is spaced from a roll ball by three spacers, that prevent the ball from sealing against the ring and provide a passage for fluid. The top and side of the ring both present an acute angle to the ball tangent. Likewise, the interior of the ball housing is provided with three lugs 20 which prevent the ball from sealing against the housing wall when the dispenser cap is applied and likewise ensure a passage for fluid within the housing. The dispenser has moulded plastic spring members that are intended to press the ball against the lip of the housing, but as explained above with regard to U.S. Pat. No. 2,968,826 if the spring is sufficiently strong to provide sealing against the rim of the housing, it will be so strong as to require excessive force to be applied the user pushing the ball against a readily deformable skin surface. Likewise, such a system is not practicable for use in respect of fluid products for contact dispensing to the under-arm, and especially if the dispenser is an invert dispenser, namely one that it is normally stored with the ball and cap at its base underneath its reservoir.

It is an object of the present invention to ameliorate one or more of the disadvantages of roll-on housings for cosmetic roll-on dispensers indicated hereinbefore.

It is a further or alternative object of at least some embodiments of the present invention to provide a housing for a cosmetic roll-on dispenser having a means for controlling the liquid adhering to the roller for application onto a contact surface, such as skin.

It is a different or complementary object of at least certain embodiments of the present invention to provide a housing for the roller of a cosmetic roll-on dispenser that is particularly suited to an invert dispenser.

STATEMENT OF INVENTION

According to the present invention, in a first aspect, there is provided a housing for a roll-on in accordance with claim 1 herein.

Herein, roller and roll-on in relation to an element which is rotated is a body having a circular periphery in at least one plane, including a cylindrical roller and especially a ball, not especially a spherical ball. Herein, the terms inward and outward when employed axially, as in inward end and outward end in respect of a housing intended for mounting on or integral mounting with a bottle reservoir refer respectively to the end adjacent to and the end remote from the reservoir. Axial relates to an axis extending centrally through the inward and outward ends of the housing.

Herein the term spider indicates a structure mounted on the interior of the side-wall of the roll-on housing below the roller comprising a plurality of spokes which radiate outwardly from a hub and/or inwardly from the side-wall, optionally linked by one or more concentric rings. The spider maintains localised contact with the roller within the housing and obstructs it from dropping into the bottle reservoir, even if the housing interior does not include any other radially-projecting inward shelf (sealing ring) that can also achieve that function.

By designing the spider such that its roller-facing surface is parallel to the opposed surface of the roller, but also providing localised contact between the spider and the roller and simultaneously biasing the spider such that it is brought into and maintained in contact with the roller during topical application of the liquid, the spokes of the spider act as wiper blades which regulate the depth of film that remains on the roller. This depth of film is controlled reproducibly by the height of the means on the spider which provide the localised contact with the roller. When the spider extends both axially and transversely within the housing, for example if the roller is in the form of a ball, the spider has an opposed surface (or leading edge) having a radius of curvature corresponding to the local radius of curvature of the roller.

The invention is particularly intended and suitable for dispensers incorporating spherical balls.

Herein, the terms upward, downward, above and below in respect of the dispenser and its constituent parts refer to when the dispenser is in an upright orientation, which is to say the cap above the bottle. Axial relates to an axis extending centrally through the inward and outward ends of the housing.

DETAILED DESCRIPTION AND PREFERRED EMBODIMENTS OF THE PRESENT INVENTION

The present invention is directed to a means for reproducibly controlling the liquid, and particularly a cosmetic liquid, that adheres to a roller on topical application of a cosmetic from a hand-held dispenser. The roller is retained within a housing forming the outlet from a bottle which can be closed with a removable cap. The invention is described with particular reference to a spherical ball, which naturally has a single radius of curvature, but can be likewise applied to oval balls, i.e. balls that have different radii of curvature in accordance with the change in radial dimension of the ball and also to rollers in the form of cylinders.

The interior of the side-wall of the housing for the roller advantageously comprises a hollow surface approximating to a sphere, oval or cylinder of radius greater than that of the roller, and commonly not greater than 105 to 115% that of the roller which is truncated at each end. Desirably, the side-wall has a lateral circumferential shoulder (inward shelf) projecting inwardly intermediate between the inward end of the housing and the centre of the ball or longitudinal axis of the cylindrical roller which provides an outwardly facing sealing ring against which the roller can be urged downwardly to form a fluid tight seal, in particular by mounting of the cap. It will be recognised that this is opposite to the dispenser of U.S. Pat. No. 2,968,826 or GB 1515078 in which sealing was said to be effected by upward force on its ball by a spring positioned inward of the ball.

An essential element of the present invention is a spider which mounted on the interior face of the housing side-wall underneath the roller, i.e. between the roller and the inward end of the housing. The spider comprises a plurality of spokes, which have upper edges which act as wiper blades as the roller carrying liquid is rotated. These blades remove excess depth of liquid film which can then drop back into the main liquid reservoir, usually a bottle that is attached underneath the housing. The spider is resilient, which to say at least a constituent spoke or spokes thereof are resilient, at least in an axial direction, and mounted so as to bias the spider upwardly, thereby keeping the spider in localised contact with the roller, when the cap is removed. When the cap is fitted the downward force exerted on the roller maintains contact between roller and spider, flexing the spider downwardly, or at least the spoke or spokes in localised contact with the roller. When the downward force is removed, the spider flexes upwardly to its rest position, pushing the roller upwards.

The spider comprises a plurality of spokes which radiate within the interior of the housing, preferably at an arc of not greater than 180° from an adjacent spoke. Two spokes can be employed, provided that they are approximately opposite each other. Preferably, the number of spokes is at least 3. and in some instances, the number of spokes is at least 4 The number of spokes is normally no greater than 12, in so as not to constrict the passage of liquid between the spokes unduly, and in several preferred embodiments is not more than 9. A convenient number is 3, 4, 5 or 6 spokes, and especially 6 spokes. Although the spokes can be arranged asymmetrically around the interior of the housing side-wall, it is preferable to employ a symmetrical arrangement, for example point or mirror symmetry.

The spider is mounted on the interior of the housing side-wall at one or more mounting points. When a single mounting point is employed, the spoke leading away from the mounting point terminates at its opposed end in a hub from which radiates at least one further spoke, and preferably from 2 to 5 further spokes. Preferably the spider is mounted on the side-wall at two or more mounting points that themselves are preferably symmetrically arranged around the interior side-wall and conveniently by 3 or 4 mounting points. The mounting points are most desirably equidistant around the housing side-wall and lateral relative to each other, i.e. all at the same axial distance below the widest diameter of the housing.

In many embodiments, the roller comprises a ball and the spider comprises a hub from which spokes radiate towards the housing side-wall. If desired, all the spokes can extend between the side-wall and the hub, and for convenience herein these can be called fixed spokes. However, some of the spokes that radiate from the hub and spokes that radiate towards the centre of the housing from the side-wall can have a free end, by which free end is meant that it is not secured to respectively the side-wall or the hub, and for convenience herein these can be called free spokes. It is preferred to employ a mixture of free and fixed spokes, for example in a ratio of from 1:2 to 2:1, and conveniently at 1:1. The free spokes tend to be more flexible whereas the fixed spokes tend to be more rigid and assist in the production of the combined housing and spider, for example in injection moulding. It is especially desirable for fixed and free spokes to arranged symmetrically, such as 1 or 2 free spokes interposed between adjacent fixed spokes. By adopting a symmetrical arrangement, the ball can be centred more easily, thereby ensuring best that the spokes control the depth of liquid film more evenly. One especially desirable arrangement comprises an even number of spokes in total being 4, 6 or 8 having alternate fixed and free spokes symmetrically arranged around the side-wall.

The concave face of the spokes correspond in radius of curvature to that of the ball, when the dispenser is in operation. The design causes formation of a substantially parallel-sided annular passage between ball and spoke. Preferably, the radius of the spoke can, within manufacturing tolerances, be calculated as r+dh where r is the radius of the ball in the immediate vicinity of the spoke and dh the height of the dimple. For an oval ball, the radius of an individual spoke will vary in line with the localised variation in radius of curvature of the ball. In practice, some small deviation can be accommodated, such as for example up to 5% of the ball radius. Of course, when the spider flexes, as happens when the cap is fitted, the radius of curvature tends to be increased.

The spider has a means for providing localised contact with the roller. This means desirably comprises a boss or pimple standing proud of the surface of the spider, specifically proud of the surface of the spokes facing the roller. The boss or pimple is desirably of round or rounded lateral cross section. The boss or pimple advantageously has a bevelled or rounded chamfer to its contact edge with the roller, thereby to minimise frictional contact with the roller. The boss or pimple advantageously is hemispherical or a cylinder terminating in a hemisphere. The orthogonal height of the pimple, which controls the depth of the liquid film adhering to the roller, is often, for a hand-held cosmetic dispenser, selected in the range of from 300 to 2000 μm and in many instances from 350 to 750 μm, and especially in conjunction with a cosmetic liquid having a viscosity of not more than 10,000 mPa·s. It is implicit that in practice the spider regulates the depth of fluid adhering to the roller when the height of the localised contact (be it boss or otherwise) is less than the depth of fluid which is capable of adhering to the roller. The mere disclosure of a boss spacing an intermediate reservoir or ring from the roller does not inherently disclose the concept of regulating the depth of fluid adhering to the roller.

The pimple or boss often has a diameter of from 300 to 2500 μm and particularly from 350 to 1000 μm, often tapering to a point (such as below 25 μm diameter) for contact with the roller. The boss or pimple can be employed on free or fixed spokes and on the hub. Advantageously, at least one pimple or boss per spoke is located at a point that is remote from the point of attachment of the spoke, either a free to the hub or the fixed to the housing side-wall as the case may be. Particularly desirably each free spoke has a pimple. Most desirably, the pimples present a symmetrical pattern. If desired any spoke can be provided with a plurality of pimples, such as 2 or 3 or more to maintain the spoke and roller surface parallel. Preferably when the housing comprises an annular sealing ring between the roller and the spider mounting point(s), any pimple on a spoke mounted on the wall is equidistant between the wall and centre of the housing or closer to the centre. Such a sealing ring can be profiled to encourage the roller to be seated across its entire surface, at one extreme, through another extreme in which contact is initially made at or adjacent to an inward lip of the ring, and the area of contact between ball and ring increased by deformation or flexing of ball and/or ring.

Alternatively, for a free spoke, the means for spacing the spoke surface from the ball surface can comprise the tip of the spoke being bent upwardly towards the ball, desirably to provide a similar spacing to that provided by a pimple. In the vicinity of the hub, the localised contact can be provided by an upstanding wall that is either continuous or discontinuous and concentric with the housing side-wall.

Desirably a free spoke extends at least about 40% the radius of the interior of the housing, so as to be relatively flexible. In many embodiments the free spoke extends up to 95% of the housing interior radius and especially from 75 to 95% particularly when it extends from a hub. When it extends from the side-wall, the free spoke particularly extends from 50 to 80% of the housing interior radius. The spokes desirably have a triangular side profile with a concave top wall matching the radius of the ball with the apex of the triangle at the hub, or closest to the hub for a free spoke that is mounted on the side-wall. Such a profile assists the spoke to flex whilst strengthening it adjacent to its mounting point. The spokes can desirably comprise an upstanding wall, often tapered and a base plate, providing a T-shaped cross section.

The concavity of the roller-facing top surface of the spokes has a similar radius to that of the ball or cylindrical roller in its immediate vicinity so as to enable the film depth to be substantially the same along the length of the spokes. The mounting of the spokes on the side-wall is such that the ball is radially spaced from the mounting at the same height as the pimple or other gap-forming means.

The top of the spoke along its length is concave for use in conjunction with a ball or if it has an axial as well as transverse component with a cylindrical roller. Transversely, the top can be flat or approximately flat, or alternatively can be concave.

Advantageously, the spokes of the spider taper slightly from base to top. This feature enables the sides of the spoke adjacent to its top to be tangential or nearly tangential to the ball, for example within about 10 degrees, thereby enabling the tip to encounter the liquid film adhering to the ball approximately orthogonally. The spokes have a surface between their sides, albeit it narrow, which faces the ball surface. Both features assist the spoke to act as a wiper blade. By contrast, if a contacting surface were to be inclined at a significantly lower angle to the ball tangent, such as at an angle of not greater than 60 degrees, its ability to act as a wiper would be compromised.

In practice, when the dispenser is employed in a conventional manner by users, most conveniently, the spacing between the spider and the roller, for example as defined by the height of the pimple or boss, is less than the spacing between the roller and the housing, even at its outward mouth. That way, the spider controls the depth of fluid adhering to the ball and thus the fluid depth is predetermined by the manufacturer. In practice, the interior chamber of the housing is dimensioned such that when the dispenser is being employed to apply fluid, to the body and e.g. the underarm, the spacing between the roller and the housing is at least 50 and often at least 100 microns larger than the orthogonal height of the means for localised contact, such as the boss or pimple.

The resilient spider biases the roller upwardly. It exerts a gentle force on the roller, which in practice is significantly lower than the force needed to seal the roller against a sealing ring, such as lower than $1/10^{th}$ of the sealing force, often less than 0.2 kg-f and commonly not greater than 0.1 kg-f. It is usually at least 0.04 kg-f and in a number of desirable embodiments is in the range of from 0.05 to 0.06 kg-f. Such a biasing force is sufficient to ensure that the roller remains in localised contact with the spider so that the spokes can continue to act as wiper blades, but is not so great as to render it difficult for the user to apply fluid to the body surface, e.g. in the underarm.

The act of regulating the depth of film can reduce or eliminate the risk of excess liquid adhering to the roller and thereby assist in reducing fluctuation in dose applied in successive applications.

When the ball is spherical, it can rotate in the housing around any axis. However, if a non-spherical ball or a cylindrical roller is employed, the ball or roller will rotate around its longitudinal axis.

The housing is conventionally employed in conjunction with a removable cap which fits over the housing and is attachable to the housing or the attached cosmetic bottle or reservoir by a reversible means that can exert or increase axial pressure of the cap. It is especially desirable to employ co-operating screw threads or a bayonet rotating across a cam surface of a lug as means of attachment of the cap. In the vicinity of such mounting means, the exterior of the bottle or housing, as the case may be, should preferably be cylindrical. If the cap is mounted on the housing, the housing side-wall in the vicinity of the cap-mounting means is preferably sufficiently rigid to resist deformation during relative rotation of cap and housing. Outward of its cap-mounting section, the housing can be more flexible, if desired, thereby saving moulding material.

When the roller is in fluid tight contact with the sealing ring, it also urges the spider away from its rest position and in particular flexes the free spokes downwardly, especially at their tip and in practice flexes them relative to the fixed spokes. When the spider comprises solely fixed spokes, then the entire spider is deformed, to at least some extent elastically. When the cap is removed, the spider or the respective spokes thereof return to their rest positions because they are resilient lifting the roller towards the outward end of the housing and forming the annular gap between spoke and roller.

The sealing ring in the housing can be modified by incorporating short axial slits to the outward edge of the ring to minimise the risk of the ring buckling when the ball is sealed against it and to encourage when necessary inflow of air to prevent or minimise the extent of a partial vacuum developing in the dispenser bottle or reservoir. The feature is described in more detail in a co-pending application of even date entitled Cosmetic Dispenser Housing and Method, the supplementary text and drawings of which are incorporated herein by reference.

The interior side-wall of the housing can additionally or alternatively incorporate a lateral groove, preferably v- or u-shaped forward of the sealing ring, and advantageously having an apex pointing towards the inward end of the housing, thereby providing a small intermediate reservoir for cosmetic liquid when the dispenser has an upright orientation.

The interior side-wall surface can additionally or alternatively incorporate one or more features to perturb fluid flow across the interior surface of the housing, such as airflow into the bottle or reservoir below, such as by the incorporation of one or more shallow baffles. Such shallow baffles are intermittent or continuous and desirably are lateral or have a lateral component. Any supplementary description and drawings in a co-pending application of even date herewith entitled "Cosmetic Dispenser Housing" is incorporated herein by reference.

The invention is directed in particular to the use of spherical balls having a diameter of from about 20 to about 40 mm and especially from about 25 to about 36 mm. Representative ball diameters are 25, 29, 32 or 35.5 mm, or thereabouts. Suitable oval balls can have a major diameter likewise of 20 to 40 mm and a ratio of major to minor diameters conveniently of from 1.1:1 to 2:1, such 4:3 or 3:2. Suitable cylinders conveniently have a length and diameter each in the range of 20 to 40 mm. The diameter may be constant or may increase from end to middle, thereby bringing the roller more closely towards a ball-shape.

The housing and spider are preferably injection moulded together in a unitary mould, employing a thermoplastic polymer such as polyethylene or polypropylene.

The housing is intended as an outlet for a roll-on bottle, the term encompassing related reservoirs such as pouches. Because the invention housing has a spider between the roller and its inward end, it is most convenient to form the housing separately from the bottle and mount the one to the other by mounting means that are recognised in the art. The mounting of housing on reservoir should employ a mode of mounting different from that by which the cap is fitted. If the cap is fitted by a rotational means, as is conventional, the housing should be mounted by an axial means. Such means of mounting can comprise an axially engaging friction fit between contacting surfaces (eg cylinders) of housing and reservoir, though preferably it comprises a snap fit mounting in which a circumferential bead on the interior surface of the reservoir side-wall snaps over a facing bead on the exterior surface of the housing lower side-wall or skirt and/or into a corresponding facing groove or both bead and groove to secure the two items together. Particularly if a snap-fit mounting means is employed, but also for other mountings, it is desirable to employ one or more annular anti-leakage beads, commonly blades of a V (delta) cross section, integrally moulded in the interface of one or other of the respective side-walls of the housing or bottle. Such a blade or blades, preferably no more than 2, tends to be flexible, at least towards its tip.

Alternatively, the housing can be mounted on the bottle by co-operating screw threads. Where a non-releasable attachment is sought, the two components can be bonded by an adhesive. Although the housing is preferably made from a thermoplastic, the bottle can be made from any of the materials which have hitherto been used to make a cosmetic bottle or proposed for such use. Such materials include glass, OR even metals and preferably a thermoplastic.

A cosmetic dispenser fitted with a housing according to the present invention normally is fitted also with a cap that is positioned over the housing and generally provides in co-operation with the housing and the roller, a sealing means to prevent egress of liquid from the dispenser. The cap can be attached directly onto the bottle or housing. It can comprise a top wall having a centrally located dependent wall that is intended to contact the roller during the capping operation and urge it towards the inward end of the housing, particular to engage with a sealing ring as described hereinabove. Alternatively or additionally it can comprise a dependent skirt or a dependent annular wall close to the skirt which is dimensioned to engage the outer side of the side-wall of the housing adjacent to its outward end and compress the side-wall onto the roller.

The cap can be affixed to the bottle or housing by a screw-thread system or alternatively by a bayonet system, supplementary details thereof as described in the text and drawings of a co-pending application of even date entitled "Attachment means for a cosmetic dispenser" being incorporated herein by reference.

The present invention is suitable for a hand-held cosmetic dispenser, that is say one holding preferably from about 15 to 120 mls as is common for a deodorant or antiperspirant or a sampler. An especially desirable bottle volume is in the range of from 40 to 75 mls liquid. The bottle can be any bottle previously employed or proposed for employment in a roll-on cosmetic dispenser, and particularly for a deodorant or antiperspirant, such as for example the bottle having a asymmetric body and optionally an angled head as described in EP-A-1175165.

The invention housing can be employed in a dispenser that is intended to be stored in an upright orientation, its bottle having a flat or concave base on which it can stand stably, or alternatively in a dispenser that is intended to be stored in an invert orientation, the cap having a flat or concave top on which it can stand stably. The respective cap top and bottle base can be shaped so as to prevent the dispenser being stored by itself stably in the other orientation, or of course both can be flat or concave so as to allow the consumer to choose which orientation is preferred.

It is especially desirable for an invert dispenser to employ a housing according to the present invention. An invert orientation for storage ensures that the roller is fully wetted prior to application and the spokes acting as wiper blades ensure that the dispenser does not permit excess liquid to be dispensed onto the contact surface such as axillary skin. Thus, the combination of invert bottle and invention housing/spider enables the benefits of proper roller wetting to be realised without the wasteful life-shortening and potentially off-putting disadvantages that would arise from not controlling the liquid film depth on the roller.

The cosmetic liquid that is dispensable from a cosmetic dispenser described herein desirably has a low to intermediate viscosity. That is to say that it is not so runny as to flow quickly from any surface to which it is contacted and not so viscous as to be difficult to wipe from a surface. The cosmetic liquid is often selected within the range of from 500 to 20,000 mPa·s (centipoise), particularly from 1000 to 10,000 mPa·s and conveniently from 1,500 to 6,000 mPa·s.

Viscosity herein conveniently refers to measurements by a conventional viscometer, such as a Brookfield viscometer at 25° C., RVT, TA, 20 rpm, Hellipath, unless otherwise stated, a stirrer and stirrer speed that are both appropriate for the specified viscosity range.

The cosmetic liquid may be a solution, for example an aqueous, or alcoholic solutions (including possibly dihydric or trihydric alcohols, if desired) for example of an astringent antiperspirant active which solutions are well known in deodorant or antiperspirant literature. Alternatively, the liquid can comprise an emulsion which may be an oil in water or a water in oil in emulsion depending on the relative proportions of the phases, their chemical nature and the choice of emulsifiers selected. Once again literature discloses examples of such cosmetic liquids. A further variation comprises a suspension of a fine particulate cosmetic active material in a suitable carrier liquid, which may for example by a water-immiscible liquid such as a volatile silicone and/or other cosmetic oil. The solution, emulsion or suspension may be thickened to any necessary extent by conventional thickeners known for such carrier fluids, including starch or cellulose derivatives, particulate clays, thickening polymers and waxes.

Having described the invention in general terms, specific embodiments thereof will be described hereinafter with reference to the accompanying drawings by way of example only.

FIGS. 1 to 5 illustrate a roll-on dispenser comprising a reservoir (1) on which is mounted a housing (2) for a spherical ball (3) covered by a cap (4).

Figure 1:
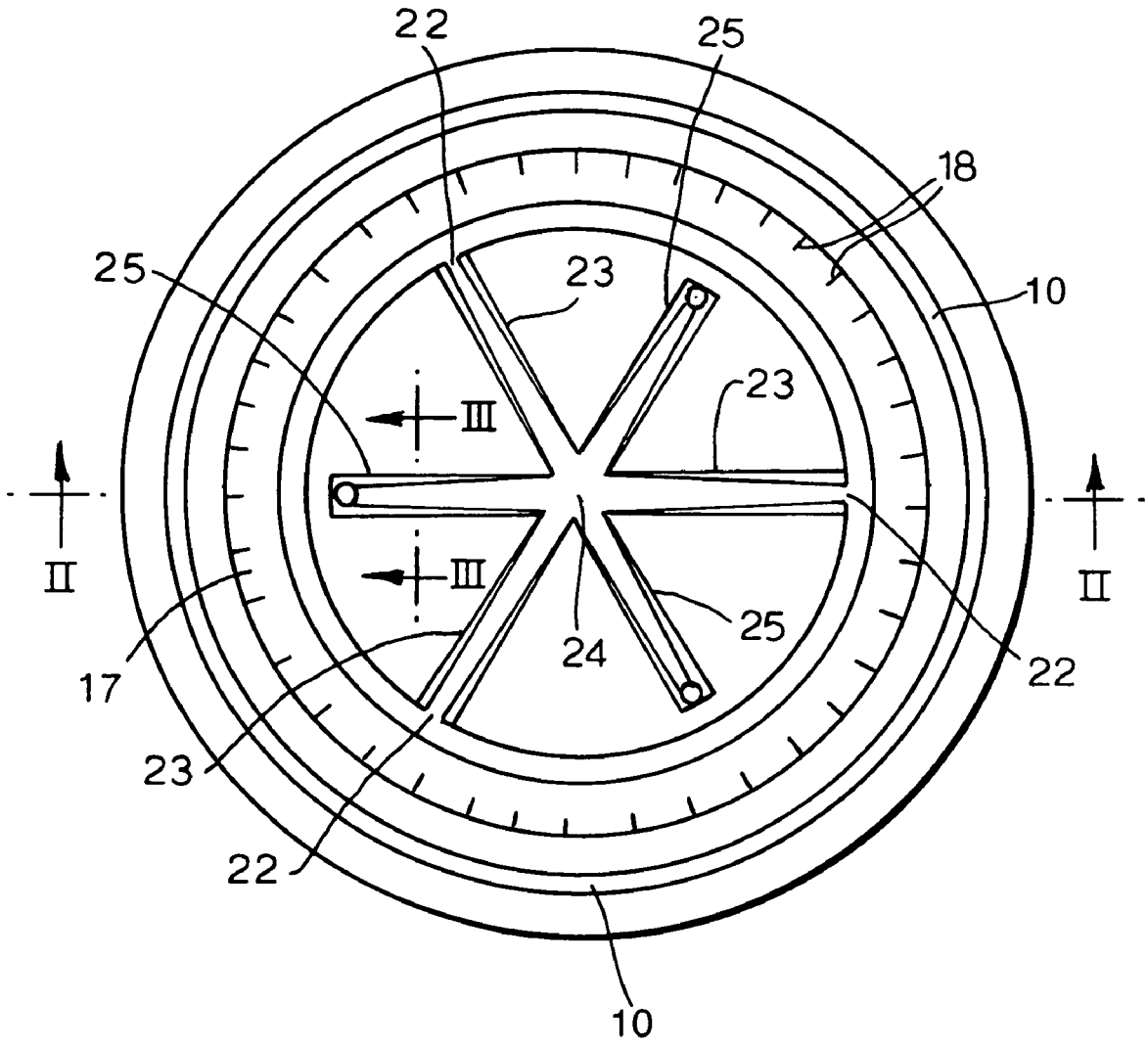
FIG. 1 is a plan view of a housing and spider without the ball in place.
Figure 2:
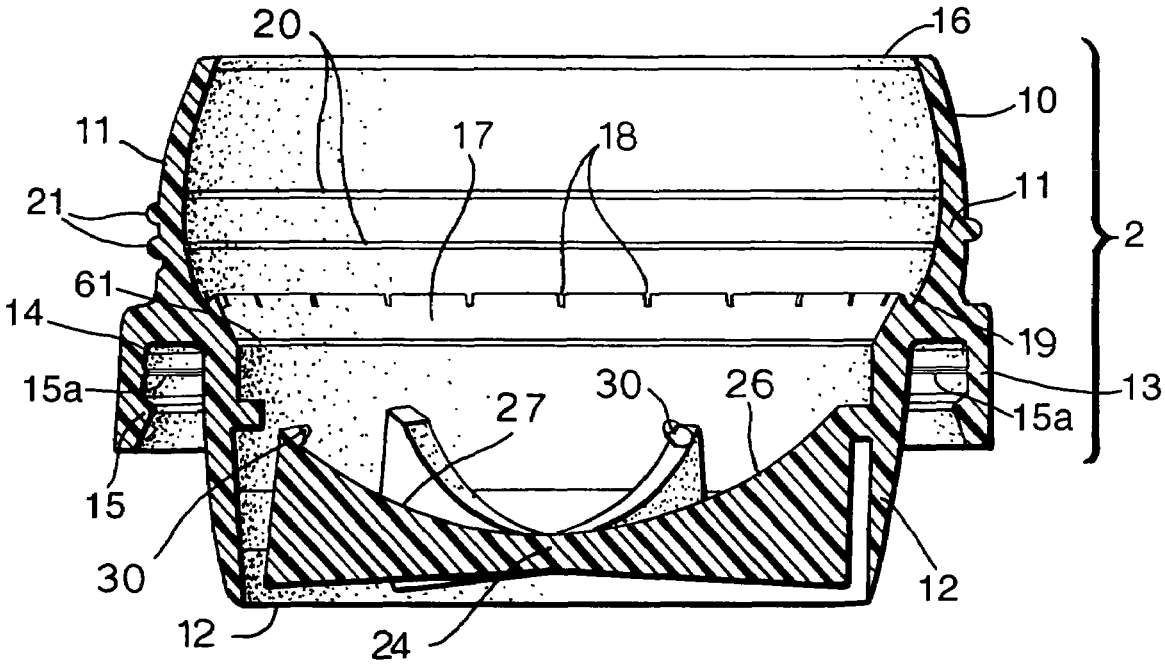
FIG. 2 is a cross section view of the housing and spider of FIG. 1 through line II-II.

The reservoir (1) has a rounded bottom (5) which prevents the dispenser from standing stably in an upright orientation and a side-wall (6) that has an annular zone (60) of reduced wall thickness defining a peripheral ledge (7) with an annular groove (8) and an annular bead (9) moulded on its exterior face above the ledge (7).

The housing (2) for the ball (3) comprises an upper side-wall (10) integrally moulded with a middle side-wall (11) and a bifurcated lower side-wall comprising an annular inner wall (12) that is dimensioned to fit within the mouth of the reservoir (1) and an annular outer wall (13) having moulded on its interior face an annular recess (14) and annular bead (15) that engages with corresponding bead (9) and groove (8) on the annular zone (60) of reduced thickness in a snap-fit mounting. A small annular anti-leakage blade (15*a*) is also integrally moulded on outer wall (13) parallel with and inward of the snap-fit bead (15). The bottom edge of outer wall (13) rests upon ledge (7) in the side-wall (6) when the housing (2) is mounted on the reservoir (1).

The upper side-wall (10) is a truncated hollow hemisphere, defining an outward end of the housing (2) otherwise referred to as a mouth (16) through which ball (3) can be pushed by virtue of its flexibility. The middle wall (11) has a screw thread (21) moulded on its cylindrical exterior face and is of sufficient rigidity to resist deformation during relative rotation of cap (4) to housing (2). The interior face of the middle wall (11) and the inner lower annular wall (12) is approximately truncated hemispherical, having an upward-facing sealing ring (17) in which a multiplicity of square edged short axial notches (18) are cut all the way around its upper edge to a depth of about 30% of the axial height of the sealing ring (17). The ring (17) defines with the middle wall (11) a v-shaped annular groove (19) which can retain fluid when the dispenser is in an upright orientation which has a similar depth to and is in fluid communication with the notches (18). The sealing ring (17) has an upstanding lip (61). The housing interior also has two parallel annular beads (20) between the sealing ring (17) and its mouth (16).

On the interior of the inner annular wall (12) is moulded a resilient flexible spider which consists of three fixed spokes (23), each of which is mounted around the wall (12) at a mounting point (22) at 120 degree intervals and radiating inwardly to intersect at a hub (24) from which radiate outwardly three free spokes (25) equidistantly spaced between adjacent fixed spokes (23). The ball-facing surfaces (26, 27) of the spokes (23, 25) are concave, and have the same radius of curvature as the ball (3) plus the height of a boss (30). The spokes (23, 25) have a transverse inverted T shaped cross section formed by a base flange (28) and an upright wall (29) slightly tapered on both sides, which are nearly parallel to the radius of the ball and hence nearly orthogonal to the tangent of the ball, having ball-facing sharp edges that assist the spokes to act as wipers and transversely having a flat top. A short boss (30) stands proud of the longitudinally extending concave surface (27) at the non-mounted end of each free spoke (25). Together with the exterior surface of the ball (3), the concave surfaces (26, 27) define a passageway (31) controlling the depth of liquid film adhering to the ball (3) as it is rotated, leading top edges of the wall (29) of spokes (23, 25) acting as wiper blades.

The cap (4) has a top wall (32) having a planar exterior which permits the dispenser to stand in an invert orientation, and from its underside a central annular wall (33) depends, of height dimensioned to depress the ball when the cap is attached. The cap (4) has an annular side wall (34) dimensioned to fit over the housing in which is moulded a screw thread (35) adjacent to its mouth and a plurality of axial ribs (36) having a concave contact face (37).

When the cap (4) is fitted by rotation onto the housing (2), screw threads (21 and 35) engage and move the cap (4) axially towards the ball (3), the annular wall (33) and the ribs contact surfaces (37) first contacting the ball (3) and then urging it inwards, i.e. down. As a consequence, the ball (3) is urged into contact with the sealing ring (17), and first of all with its lip (61) and because the ball is always in contact with the bosses (30) on the three free spokes (25), the free spokes are flexed downwardly, especially in the vicinity of the bosses (30) and the spider is distorted.

When the cap (4) is removed, again by rotation, but in the reverse direction, the axial force exerted by the cap is removed and resilient spider returns to its rest position, so that the ball is gently lifted above the sealing ring on bosses (30) and cosmetic fluid can pass between the ball (3) and sealing ring (17) and through a channel (31) of predetermined radial width between the ball and the spider spokes (23, 25). The depth of film adhering to the ball (3) is controlled defined by the height of the bosses (30) on concave surface (27) of the spokes (25). In topical application, when the ball is pressed against the body, such as an armpit, the ball is spaced away from the upper wall section (10) of the housing (2). Flanges (28) at the base of spokes (23, 25) tend to restrict the flow of liquid back into the bottle reservoir when the bottle is turned into an upright orientation.

Figure 6:
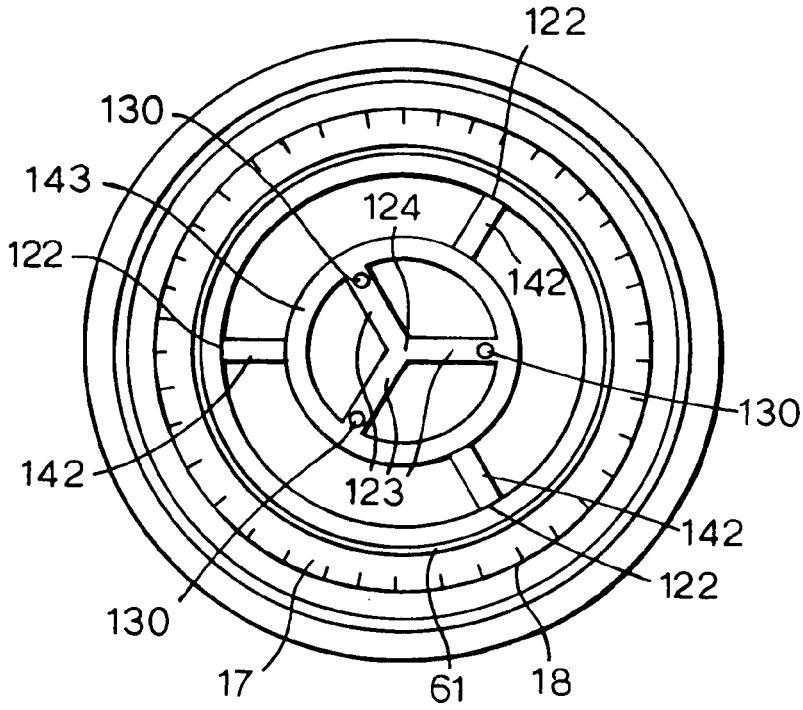
FIG. 6 is a plan view of an alternative spider.
Figure 7:
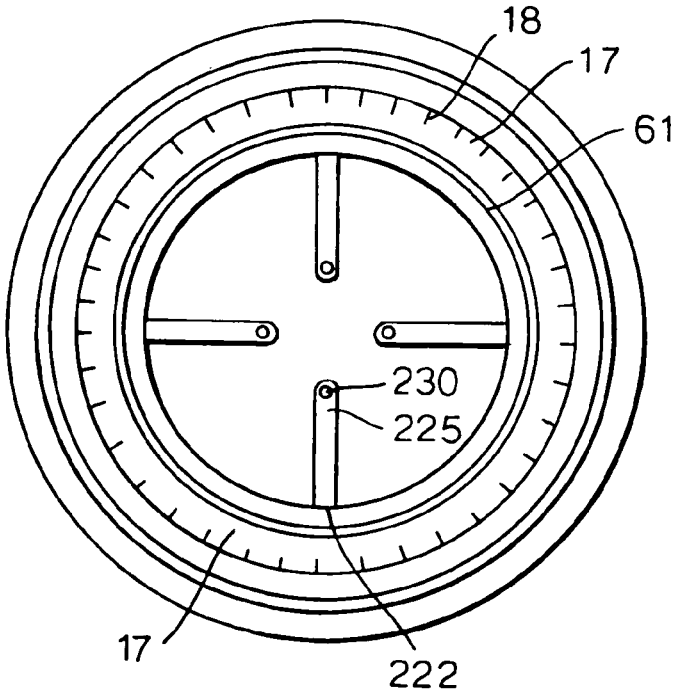
FIG. 7 is a plan view of a second alternative spider.

FIGS. 6 and 7 illustrate two alternative designs of spider mounted in the same housing for covering by the same cap and for mounting on the same reservoir as in FIGS. 1 to 5.

In FIG. 6, the design of spider comprises three mounting spokes (142) extending from their mounting points (122) on the housing (3) (120° apart) to an intermediate concentric ring (143) from which three fixed spokes (123) extend to a hub (124). The fixed spokes are rotated by 60° from the mounting spokes around the intermediate ring. Pimples (130) are located at each fixed spoke (123) adjacent to the intermediate ring (143). The fixed and mounting spokes each have a concave ball-facing surface of slightly greater radius than that of the ball, so that they form an annular gap with the ball having a depth defined by that of the pimples (130).

In FIG. 7, the design of the spider comprise four free spokes (225) in point symmetry, each of which extends radially inwards from their mounting points (222) of the housing (3) by about $2/3^{rd}$ the radius of the housing at that point, and having a pimple (230) to their free end. The free spokes (225) of this design likewise have the ball-facing profile and cross section of the free spokes in the design of FIG. 1, so that together with the ball they form an annular gap having a depth defined by that of the pimples (230).

Figure 3:
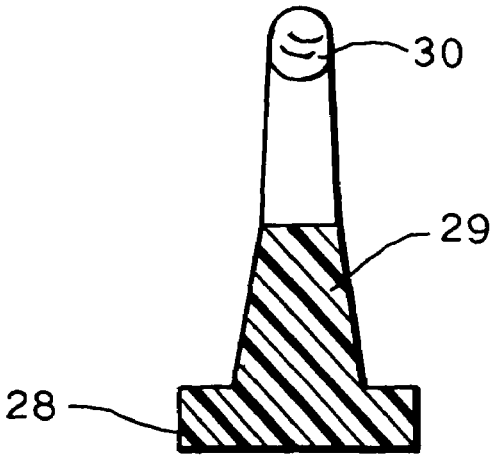
FIG. 3 is a radially outward cross section view of a spoke in the spider of FIGS. 1 and 2 through line III-III.
Figure 4:
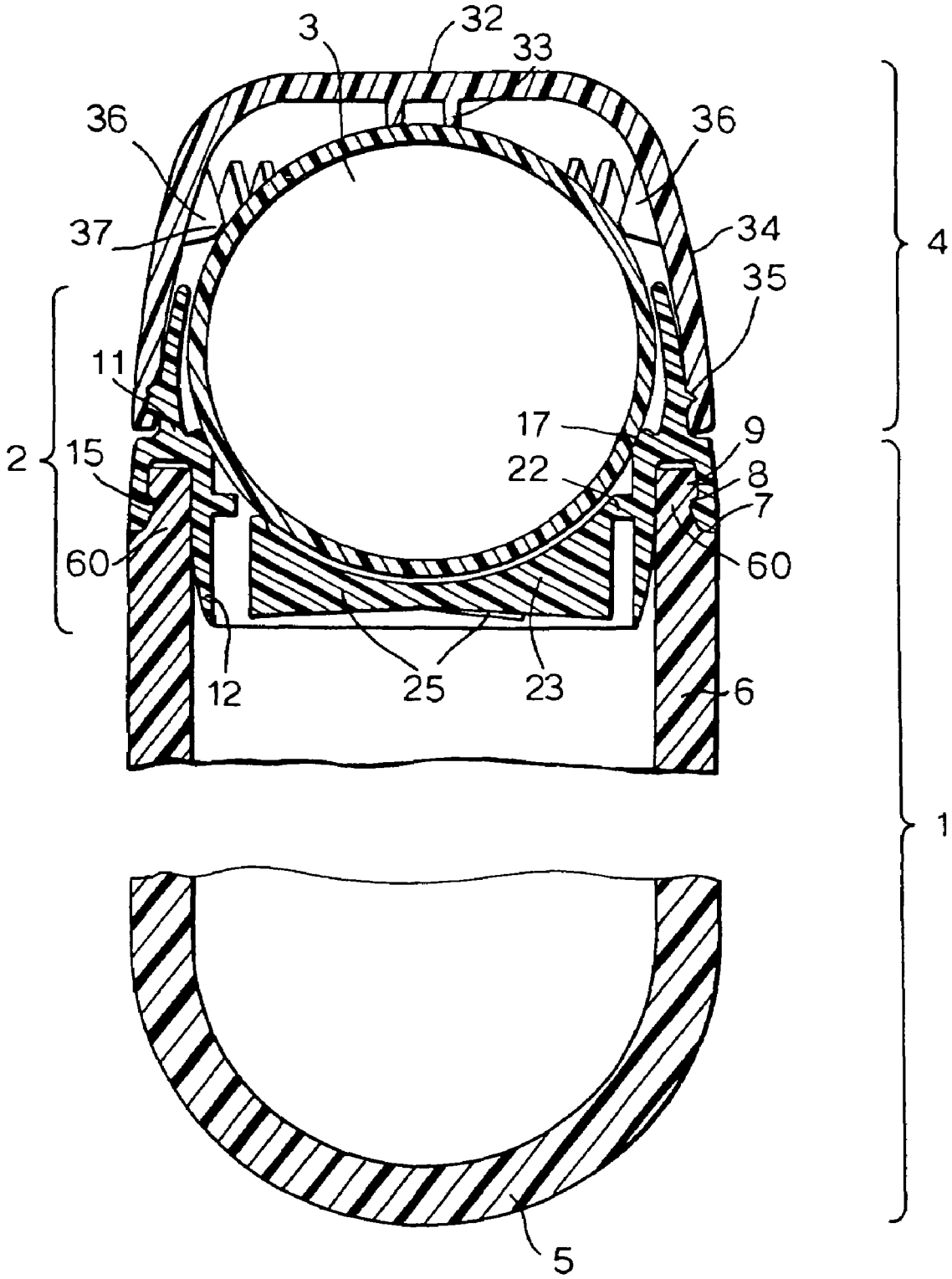
FIG. 4 is a cross section view of a dispenser showing housing, spider and ball of FIGS. 1 and 2 also through line II-II when the ball and housing are urged into fluid tight contact by the cap.
Figure 5:
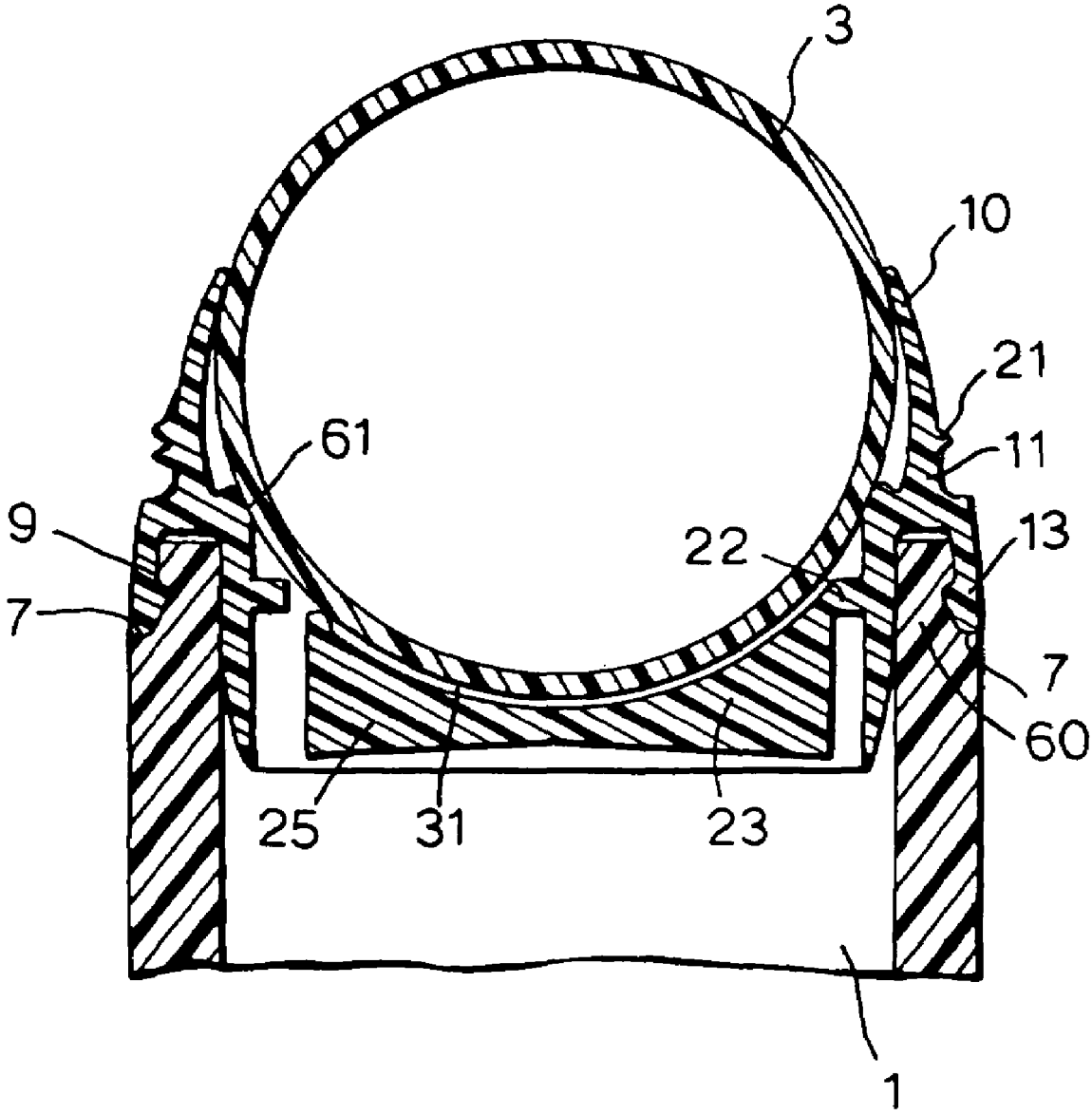
FIG. 5 is a cross section view of the dispenser of FIG. 4 when the cap has been removed.

The spokes (123,225) have a similar lateral cross section and axial profile to spokes (25) illustrated in FIGS. 3 and 4 respectively.

The dispensers described herein with respect to the aforementioned FIGS. 1 to 5 or 6 or 7, are especially suitable for hand-held cosmetic dispensers having a capacity of from 40 to 75 mls, such as 45, 50 or 55 mls. incorporating roll-balls having a diameter of from 25 to 35 mm, such as 25, 29, 32 or 35.5 mm.

Figure 8:
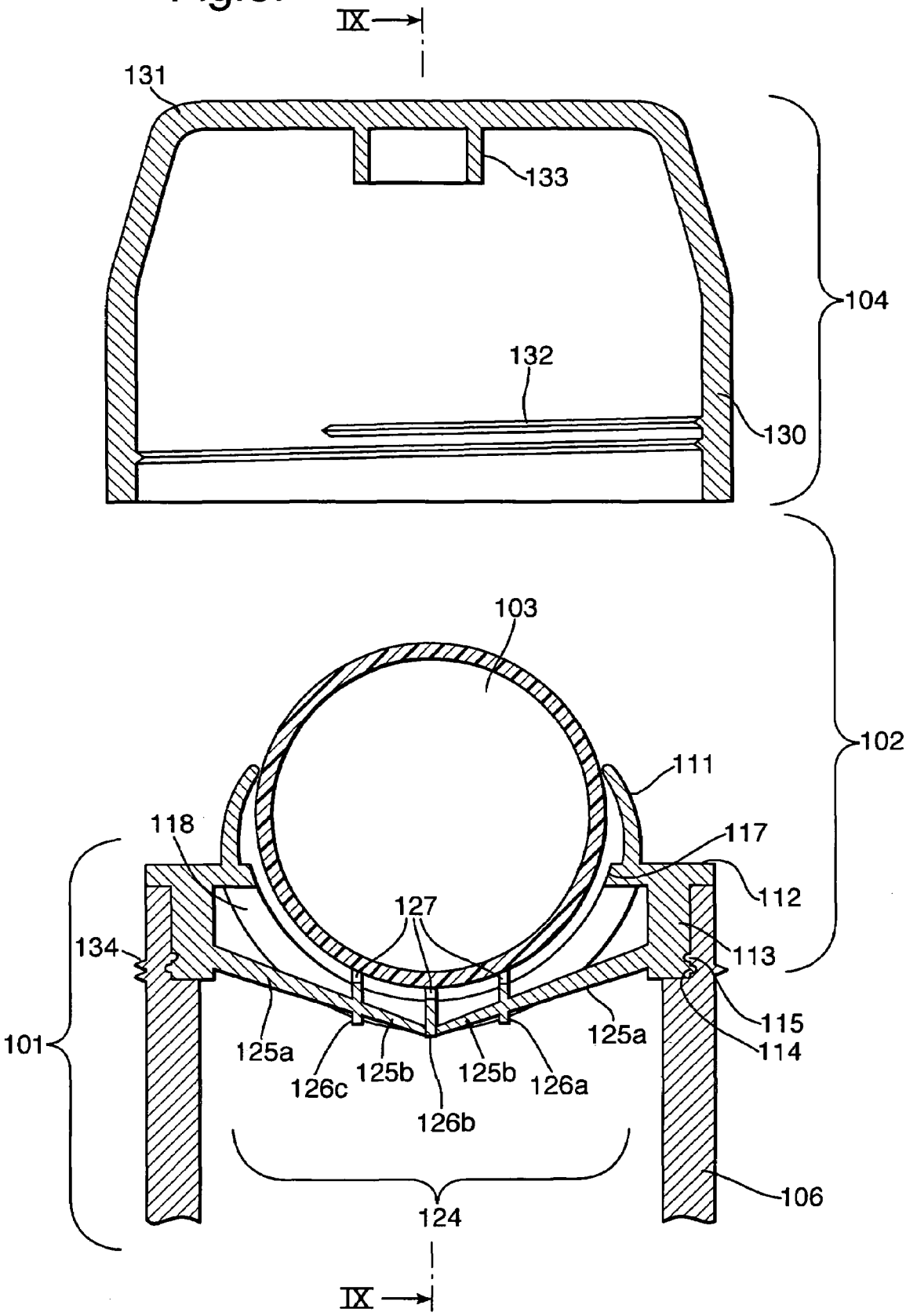
FIG. 8 is an expanded central cross section of an alternative housing for a cylindrical roller and a cap therefor, viewed along the axis of the cylindrical roller.
Figure 9:
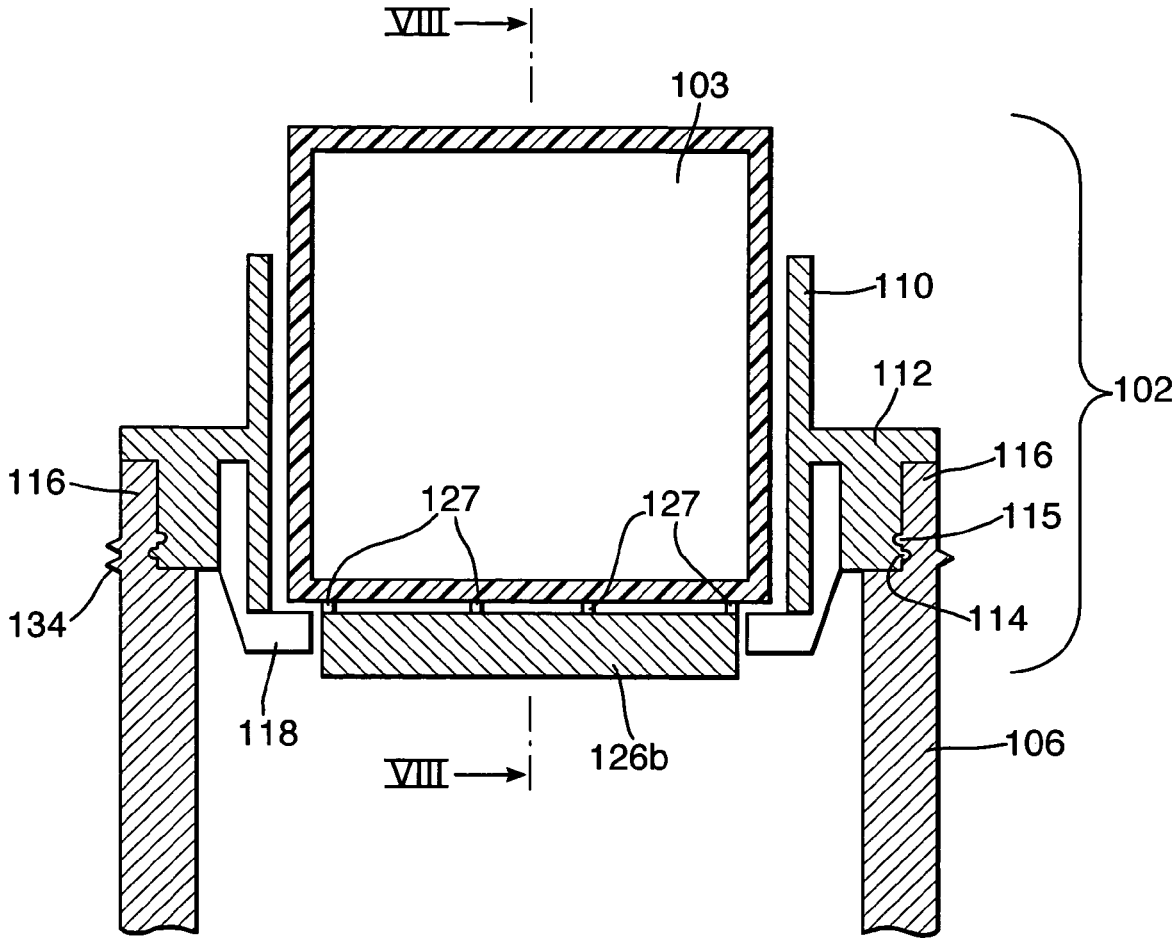
FIG. 9 is a central cross section of the dispenser of FIG. 8 viewed transverse to the roller axis.

The dispenser described in relation to FIGS. 8 and 9 comprises a reservoir (101) having a side-wall (106) on which is mounted a housing (102) for a cylindrical roller (103) and on which is mountable a cap (104).

The housing (102) has a flexible upper wall (111) that extends longitudinally parallel with the roller (103) and has two upstanding ends (110) beside the ends of the cylinder roller (103), through which the roller can be pushed. Below the flexible wall (111) is positioned a shelf (117) with a radiused inner face which extends longitudinally parallel on both sides of the roller (103) and adjacent to each end a semi-circular shelf (118) extends beneath roller (103). Shelves (117, 118) combine to seal the dispenser when cap (104) is mounted on reservoir (106).

The housing (102) has a lateral flange (112) integrally moulded with a circular wall (113) having a peripheral snap-fit bead (114). A spider (124) is integrally moulded with circular wall (113) and comprises three pairs of mounting struts (125*a*, 125*b*) located symmetrically along the housing (102) beneath and transverse to the roller (103), which support three spokes (126*a*, 126*b*, 126*c*) each having 4 pimples (127) and a similar transverse cross section to the spokes of the previously illustrated dispenser. The spokes are biased by the mounting struts into contact with the roller (103), thereby defining a narrow channel between the upper surface of the spokes and the adjacent surface of the roller. Excess fluid is wiped off by the spokes.

The reservoir sidewall (106) has a stepped upper section (116) that acts as a seating for housing cylindrical wall (113) and carries internally a co-operating snap-fit bead (115) and externally a screw moulding (134).

Cap (104) comprises a cylindrical side-wall (130) moulded with a co-operating screw (132) and a top wall (131) from which depends a circular contact wall internally (133). When the cap (104) is mounted on the bottle (106) the contact wall (133) bears down on the cylinder (103), urging the latter into fluid tight contact with shelves (117 and 118).

Figure 10:
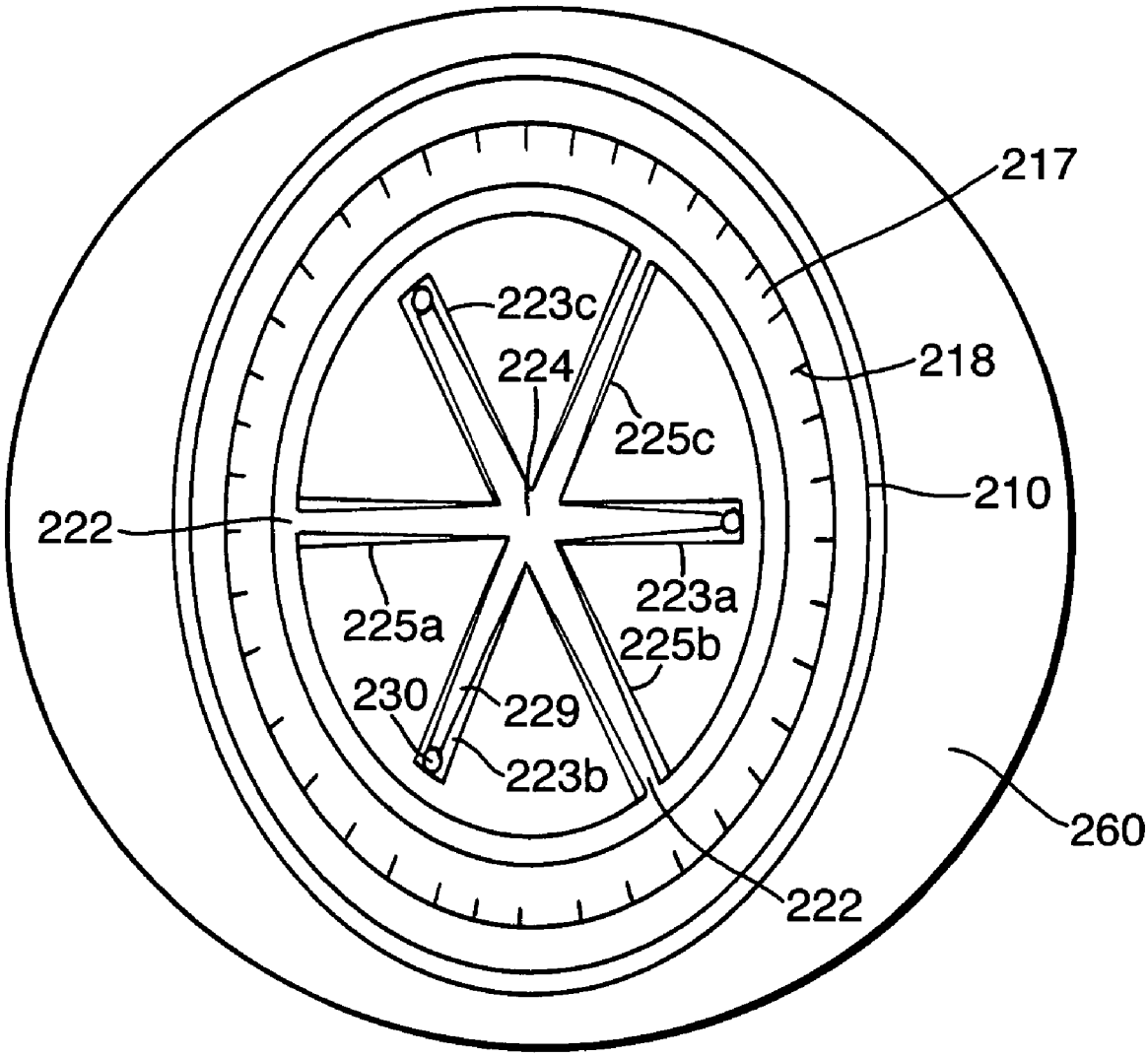
FIG. 10 is a plan view of a housing and spider for a dispenser employing an oval ball that otherwise is the same as the dispenser of FIGS. 1 to 5.

The dispenser that is illustrated in FIG. 10 comprises the same elements of that of FIG. 1, but modified to accommodate an oval ball instead of a spherical ball. The principal modifications are that the housing is oval in transverse cross sec-wall (210), and sealing ring (217) are both oval as well as beads (220) and V-shaped reservoir (219) that cannot be seen in FIG. 10, but would be apparent in a Figure corresponding to FIG. 2. In addition, the spokes (223*b*, 223*c* and 225*b*, 225*c*) have longer lengths and different curvature where they extend over an ovulate section of the ball (not seen in FIG. 10) compared with the shorter length and tighter radius of curvature of spokes (223*a*, 225*a*) at the minor diameter of the ball. The housing also has a flange (260) of circular periphery to which a cap (not illustrated) can be mounted by screw co-operating threads.

The invention claimed is:

1. A housing for a roller having an inward end, an outward end and a side-wall having an interior surface extending from the inward end to the outward end, the side-wall dimensioned to retain the roller and permit a segment of the roller to extend outside the housing, and a spider mounted laterally within the housing on the interior surface of the side-wall at or adjacent to the inward end said side-wall or said spider preventing the roller from falling through the inward end, wherein the roller has a surface that conveys a film of liquid from the inside to the outside of the housing and wherein the spider is resiliently biased towards and has a means for providing localised contact with and parallel spacing from the roller as well as controlling the depth of liquid film on the roller surface, and wherein the spider comprises at least one free spoke having an unattached end.

2. A housing according to claim 1 characterised in that the roller is a ball.

3. A housing according to claim 1 characterised in that the spider comprises at least 3 spokes.

4. A housing according to claim 3 in which the spokes have a triangular profile, having a concave top wall of similar radius to the ball, and an apex that is at or adjacent to the centre of the housing.

5. A housing according to claim 3 characterised in that the spokes have a wall and base wall having a T-shaped cross section.

6. A housing according to claim 1 characterised in that the spider comprises not greater than 12 spokes.

7. A housing according to claim 6 characterised in that the spider comprises from 3 to 9 spokes.

8. A housing according to claim 7 characterised in that the spider comprises 3, 4, 5 or 6 spokes.

9. A housing according to claim 1 characterised in that the spider is mounted on the interior of the side-wall at 2, 3 or 4 points.

10. A housing according to claim 1 characterised in that the spider has from 2 to 6 free spokes.

11. A housing according to claim 1 characterised in that the free spokes radiate from a hub attached to the side-wall via at least one fixed spoke.

12. A housing according to claim 11 characterised in that the free and fixed spokes are arranged symmetrically.

13. A housing according to claim 12 characterised in that the free and fixed spokes are arranged alternately.

14. A housing according to claim 1 characterised in that the spider has 1 or 2 free spokes per fixed spoke.

15. A housing according to claim 1 characterised in that the free spoke is mounted on the interior of the side-wall.

16. A housing according to claim 1 characterised in that a free spoke extends from 40 to 95% of the radius of the interior of the housing.

17. A housing according to claim 1 characterised in that the localised contact is provided by a pimple or boss that is part of the ball-facing surface of the spider or spokes.

18. A housing according to claim 17 characterised in that the pimple or boss is located remote from its point of attachment or mounting.

19. A housing according to claim 17 characterised in that the pimple or boss is hemispherical or cylindrical having a rounded top wall.

20. A housing according to claim 17 characterised in that the pimple or boss has a height of from 300 to 2000 □m.

21. A housing according to claim 20 characterised in that the pimple or boss has a height of 350 to 750 μm.

22. A housing according to claim 1 characterised in that the localised contact means comprises the free spoke being bent towards the ball at its unattached end.

23. A housing according to claim 1 which is characterised by the interior surface of the side-wall having a lateral sealing shelf intermediate between the roller and the spider which can form a fluid tight seal with the ball when the latter is urged towards the inward end of the housing.

24. A housing according to claim 1 characterised in that the interior of its side-wall includes a circumferential groove intermediate between the inward and outward ends of the housing that can act as a secondary reservoir for fluid.

25. A housing according to claim 1 which is so adapted that the spacing between opposed surfaces of the spider and roller is less than the spacing between the ball and its housing, when fluid is being dispensed to an underarm from a dispenser in which the housing is mounted.

26. A housing according to claim 1 in which the ball is spherical.

27. A housing according to claim 1 characterised in that it comprises an annular bead dimensioned and positioned to form a snap-fit mounting with a corresponding bead on a bottle on which the housing is mounted.

28. A housing according to claim 1 characterised in that it comprises an annular sealing bead dimensioned and positioned to form a seal between the housing and a bottle on which the housing is mounted.

29. A fluid dispenser comprising a roller, and a housing and spider according to claim 1, said dispenser further comprising a bottle attached to the housing at its inward end having an interior in fluid communication with the roller, and a removable cap that when fitted over the housing is adapted to create a fluid-tight seal by urging the roller and the housing into contact.

* * * * *